US007820571B2

(12) United States Patent
Kuroda et al.

(10) Patent No.: US 7,820,571 B2
(45) Date of Patent: Oct. 26, 2010

(54) WOVEN OR KNITTED FABRIC EXHIBITING REVERSIBLY CHANGEABLE AIR PERMEABILITY

(75) Inventors: Hisashi Kuroda, Toyama (JP); Mitsuo Tanaka, Aichi (JP); Mitsuaki Shiotsuki, Osaka (JP); Teruhiro Tsuchida, Tokyo (JP)

(73) Assignees: Mitsubishi Rayon Co., Ltd., Tokyo (JP); Mitsubishi Rayon Textile Co., Ltd., Osaka-shi (JP)

( * ) Notice: Subject to any disclaimer, the term of this patent is extended or adjusted under 35 U.S.C. 154(b) by 388 days.

(21) Appl. No.: 11/628,223

(22) PCT Filed: May 18, 2005

(86) PCT No.: PCT/JP2005/009055

§ 371 (c)(1),
(2), (4) Date: Jan. 30, 2007

(87) PCT Pub. No.: WO2005/118931

PCT Pub. Date: Dec. 15, 2005

(65) Prior Publication Data

US 2008/0268735 A1 Oct. 30, 2008

(30) Foreign Application Priority Data

Jun. 1, 2004 (JP) ..... 2004-163108
Nov. 8, 2004 (JP) ..... 2004-324162

(51) Int. Cl.
*D03D 15/00* (2006.01)
*D03D 11/00* (2006.01)
*D04B 1/14* (2006.01)
*D04B 1/20* (2006.01)

(52) U.S. Cl. ..... 442/301; 442/239; 442/318

(58) Field of Classification Search ..... 428/913; 442/203, 205, 239, 301, 304, 312, 318
See application file for complete search history.

(56) References Cited

U.S. PATENT DOCUMENTS

2006/0223400 A1* 10/2006 Yasui et al. ..... 442/181
2006/0270293 A1* 11/2006 Yasui et al. ..... 442/181
2007/0004303 A1* 1/2007 Tanaka et al. ..... 442/182
2008/0085398 A1* 4/2008 Yasui et al. ..... 428/152
2008/0132133 A1* 6/2008 Yasui et al. ..... 442/200
2008/0254263 A1* 10/2008 Yasui et al. ..... 428/172
2009/0029616 A1* 1/2009 Kanatani ..... 442/189
2009/0260124 A1* 10/2009 Yasui et al. ..... 2/69

FOREIGN PATENT DOCUMENTS

| | | | | |
|---|---|---|---|---|
| EP | 1752571 | A1 | * | 2/2007 |
| JP | 75004765 | B | * | 2/1975 |
| JP | 60252746 | A | * | 12/1985 |
| JP | 62162043 | A | * | 7/1987 |
| JP | 10008375 | A | * | 1/1998 |
| JP | 2002 180323 | | | 6/2002 |
| JP | 2003 41462 | | | 2/2003 |
| JP | 2003041444 | A | * | 2/2003 |
| JP | 2003041462 | A | * | 2/2003 |
| JP | 2005 23431 | | | 1/2005 |
| JP | 2005023431 | A | * | 1/2005 |
| JP | 2005036374 | A | * | 2/2005 |
| JP | 2005146497 | A | * | 6/2005 |
| JP | 2005163225 | A | * | 6/2005 |
| JP | 2006132010 | A | * | 5/2006 |
| JP | 2006161237 | A | * | 6/2006 |
| JP | 3834018 | | | 7/2006 |
| JP | 2007154358 | A | * | 6/2007 |
| JP | 2008111214 | A | * | 5/2008 |
| JP | 2008274476 | A | * | 11/2008 |
| JP | 2008274477 | A | * | 11/2008 |
| WO | WO 2005118931 | A1 | * | 12/2005 |
| WO | WO 2006062061 | A1 | * | 6/2006 |
| WO | WO 2007004589 | A1 | * | 1/2007 |

OTHER PUBLICATIONS

Machine translation of JP 2002-180323 A, Jun. 26, 2002.*

* cited by examiner

*Primary Examiner*—Cheryl Juska
(74) *Attorney, Agent, or Firm*—Oblon, Spivak, McClelland, Maier & Neustadt, L.L.P.

(57) ABSTRACT

A multi-layer woven or knitted fabric exhibiting reversibly changeable air permeability, which contains reversibly crimping cellulose acetate fibers exhibiting a percentage of crimp of less than 10% at a humidity of 95% or above and a percentage of crimp of 20% or above at a humidity of 45% or below and which has a basis weight of 100 to 350 g/m$^2$. When water content of the fabric is enhanced by the absorption of water or moisture, the air permeability of the fabric increases to inhibit in-clothes stuffiness or stickiness due to sweat and in-clothes temperature rise, while when the fabric has discharged the water into the outside environment, the air permeability of the fabric decreases to the original one to prevent the body temperature from lowering excessively because of the heat of vaporization and thus keep the in-clothes environment comfortable.

7 Claims, No Drawings

WOVEN OR KNITTED FABRIC EXHIBITING REVERSIBLY CHANGEABLE AIR PERMEABILITY

TECHNICAL FIELD

The present invention relates to a woven or knitted fabric that allows reversible variation of air permeability.

BACKGROUND ART

High fashion trend and consumer needs in recent years have extremely been diversified, and in order to provide woven or knitted fabrics for clothes for demands of consumers, more improved touch and specialized function are needed. It has been desired to provide woven or knitted fabrics for clothes having such specialized functions that allow reversible variation of air permeability of clothes, and adjustment of temperature and humidity in clothes, depending on variation of temperature, humidity etc. in clothes, and thereby enabling consistent maintenance of environment in clothes in a comfortable state.

It has been conventionally known that natural fibers, such as cotton and wool, have reversibly changeable physical properties depending on moisture or water content. This high-level water retention of raw materials give slower speed in variation between a dried state and a wet state, resulting in slower air permeability variation and small difference of air permeability in the clothing.

For this reason, various investigations in synthetic fibers have been performed. For example, Patent Document 1 describes an air permeability self-adapting woven or knitted fabric comprising a compounded fiber having reversibly changeable percentage crimp based on humidity variation, the fiber being made of a modified polyethylene terephthalate containing sulfonate groups, and a nylon compounded in a state side by side.

However, both of the polyester and nylon in this method can only demonstrate insufficient water absorption property and moisture absorption property, and can provide small variation of form owing to humidity or water content, leading to insufficient air permeability variation, and unsatisfactory water absorption property and quick-drying capability of woven or knitted fabrics obtained.

In addition, Patent Document 2 describes a woven or knitted fabric using a cellulose acetate fiber obtained by alkali treatment of a fiber through compound spinning, into a shape side by side at a predetermined weight ratio, of cellulose acetates exhibiting reversibly crimping performance and having difference of average degree of substitution not less than a predetermined value. The fabric cannot demonstrate neither sufficient dimensional stability as a woven or knitted fabric, nor quick-drying capability because of reversible change of crimp by means of humidity.

Patent document 1: Japanese Patent Application Laid-Open Publication No. 2003-41462

Patent document 2: Japanese Patent Application Laid-Open publication No. 2002-180323

DISCLOSURE OF THE INVENTION

Problem to be Solved by the Invention

In order to solve problems in such prior arts, the present invention aims at providing a woven or knitted fabric exhibiting reversibly changeable air permeability, the fabric being able to provide larger variation of air permeability based on variation of humidity or moisture percentage, and able to demonstrate outstanding water absorption, moisture absorption, quick-drying capability, textile strength, and dimensional stability.

Means for Solving the Problem

An object of the present invention may be attained by a woven or knitted fabric exhibiting reversibly changeable air permeability of a multilayer structure, as a fundamental configuration of the present invention, wherein the fabric comprises a cellulose acetate fiber having reversibly crimping property that exhibits a percentage crimp of less than 10% at a humidity of not less than 95%, and a percentage crimp of not less than 20% at a humidity of not more than 45%, and has a multilayer structure having a basis weight of 100 to 350 g/m$^2$.

ADVANTAGE OF THE INVENTION

According to the woven or knitted fabric exhibiting reversibly changeable air permeability of the present invention, when water absorption and moisture absorption make the woven or knitted fabric has a high moisture percentage, this woven or knitted fabric has a larger air permeability, whereby the fabric suppresses stuffiness, sticky touch, or temperature rise in clothes at a time of sweating. After discharging the moisture of the woven or knitted fabric to outside environment, air permeability will return to an original state, thereby preventing excessive decrease of body temperature based on heat of vaporization and keeping environment in clothes comfortable.

BEST MODE FOR CARRYING OUT THE INVENTION

The woven or knitted fabric of the present invention needs to include a reversibly crimping cellulose acetate fiber, the fabric having reversibly crimping property that exhibits a percentage crimp of less than 10% at a humidity of not less than 95%, and a percentage crimp of not less than 20% at a humidity of not more than 45%. On one hand, the cellulose acetate fiber has a percentage crimp of less than 10% in an environment not less than 95% of humidity. For this reason, the woven or knitted fabric has larger loops in an environment of sweating, whereby the air permeability of the woven or knitted fabric will increase. On the other hand, since the cellulose acetate fiber has a percentage crimp of not less than 20% at a humidity of not more than 45%, the air permeability decreases in a dry environment and thermal insulation and touch due to crimp will improve.

Furthermore, in the present invention, the acetate fiber has a large variation of fiber form based on variation of moisture percentage. Therefore, when the woven or knitted fabric includes one layer having reversibly varying air permeability, dimensional stability and strength of the woven or knitted fabric will decrease by the reversible variation. Accordingly, it is necessary for the woven or knitted fabric of the present invention to have a multilayer structure.

The woven or knitted fabric having a multilayer structure includes woven or knitted fabrics with two-layered structure having a front layer and a back layer, and woven or knitted fabrics with three-layered structure having a further middle layer etc. At least one layer in the above-described layers should just have reversibly changeable air permeability. Here, since it is preferable that a skin side as a sweating area, i.e., a back layer has reversibly changeable air permeability in order to effectively absorb moisture and sweat and further to make the fabric dry, it is more desirable for the back layer to include a reversibly crimping cellulose acetate fiber.

Furthermore, in the present invention, it is necessary for a basis weight to be 100 to 350 g/m$^2$. A larger degree of freedom of the fiber in a woven or knitted fabric construction and a larger space in the woven or knitted fabric increase reversible variation of air permeability, but a basis weight of less than 100 g/m$^2$ reduces form stability of the woven or knitted fabric. In addition, a woven or knitted fabric having a higher density gives insufficient variation of the air permeability, and causes slower drop in residual water content percentage. For this reason, a mass per unit area needs to be not more than 350 g/m$^2$. A basis weight exceeding 350 g/m$^2$ excessively raises the density of the woven or knitted fabric and reduces the variation of the air permeability by water absorption and moisture absorption. As a result, it will be difficult for the fabric to prevent stuffiness, sticky touch, and temperature rise at a time of sweating, leading to deterioration of a rate of drying.

Furthermore in the present invention, in view of prevention of transparency, retention of woven or knitted fabric strength and dimensional stability, the front layer and the back layer of the woven or knitted fabric preferably have a density different from each other, a ratio of back layer density/front layer density as a ratio between the densities of the front layer and of the back layer in the woven or knitted fabric desirably gives a value not less than 1.2.

A density of woven fabrics may be represented with a ratio between a number of woven points per unit area existing in a floating state in the front or the back. The density of woven fabrics may be obtained by a following equation.

Density=(number of woven points of warp yarn existing in floating state per unit area×√dtex (or 10/√yarn number count)+number of woven points of weft yarn existing in floating state per unit area×√dtex (or 10/√yarn number count))/unit area A density of knitted fabrics may be obtained by a following equation.

Density={√dtex (or 10/√yarn number count)}×number of courses/2.54 cm}×{√dtex (or 10/√yarn number count)×number of wales/2.54 cm}

The number of courses and the number of wales in this case may be determined by a number of knitted points in each layer, that is, by knitted stitches formed with loops in knitted fabric. When yarns are constructed with the front layer and the back layer and both yarns cannot be clearly distinguished, the number of courses and the number of wales may be calculated by multiplying a ratio of the number of constructed points in each layer by the front layer or the back layer of (√dtex (or 10/√yarn number count)×number of courses/2.54 cm) or (√dtex (or 10/√yarn number count)×number of wales/2.54 cm) respectively.

In addition, even in a case of the fiber of the back layer also constituting a part of the front layer, the fiber is defined as a fiber that constitutes the back layer when the fiber constitutes more knitted loops of the back layers as compared with knitted loops of the front layer.

Furthermore, it is preferred that at least one knitted construction of the front layer or the back layer is formed of an all-needle stitch construction in the present invention. In knitting the front layer or the back layer, 1/1 construction and an all-needle stitch construction are fundamentally used for knitting of one course. The all-needle stitch construction is more preferred than 1/1 construction. Knitted construction comprising the all-needle stitch includes 2/2 and 3/1 constructions etc. Knitted constructions knitted by continuous two or more loops, that is, knitted constructions comprising an all-needle stitch are preferred.

Knitted constructions comprising all-needle stitch has longer loop lengths compared with those in 1/1 constructions, and therefore, the constructions have outstanding elasticity and gives larger air permeability difference. Although knitted constructions having both of the front layer and the back layer constituted by an all-needle stitch construction are most preferred, the all-needle stitch construction may be used for only one layer. As such knitted fabrics, there may be mentioned knitted fabrics having the front layer constituted of an all-needle stitch construction and the back layer constituted of a broad stitch single tuck construction, and knitted fabrics having the front layer of a 1/1 construction, and the back layer of a single tuck all-needle stitch construction etc.

From a viewpoint of strength maintenance and form stability of the woven or knitted fabric, the reversibly crimping cellulose acetate fiber may be used as a compounded fiber in a form of a twisted yarn, intermingled yarn, etc. with polyester fibers, polyamide fibers, etc. and the cellulose acetate fiber is preferably contained by a proportion of not less than 20% by weight, and more preferably by a proportion of not less than 30% by weight.

Furthermore in the present invention, inclusion of the cellulose acetate fiber raises performances, such as luster, deep color tone, color enhancement, dry feeling, moderate moisture absorption property, etc. as characteristics to the cellulose acetate fiber. Cellulose acetate fibers also include fibers obtained by compounding acetates having different acetylation degree, and in this case one of the fibers compounded may necessarily be cellulose acetate.

Furthermore, in the present invention, the proportion of the residual water content percentage 20 minutes after the start of measurement is preferably not less than 50% in measurement of the proportion of residual water. The proportion exceeding 50% of the residual water content percentage 20 minutes after the start of measurement reduces the rate of drying of moisture absorbed by the woven or knitted fabric, easily causing sticky touch.

In the present invention, it is preferred that the temperature rise after 10 minutes is not more than 4° C., under conditions of heat supply amount 2.33 (W/100 cm$^2$) and perspiration amount 0.5 (g/100 cm$^2$), and furthermore it is also preferred that an artificial skin temperature falls to an initial temperature within 5 minutes later under conditions of heat supply amount 0.58 (W/100 cm$^2$) and perspiration amount 0 (g/100 cm$^2$) in measurement of the artificial skin temperature.

Suppression of the temperature rise within 4° C. after 10 minutes under conditions of heat supply amount 2.33 (W/100 cm$^2$) and perspiration amount 0.5 (g/cm$^2$) will make it possible to prevent excessive rise of the body temperature and sweating on exercise. The temperature rise more than 4° C. increases rise of the body temperature and perspiration amount, and easily increases stuffiness and sticky touch.

Furthermore, capability making the temperature of the artificial skin fall to be not more than the initial temperature within 5 minutes will immediately lower the body temperature after exercise and easily suppress perspiration when, after 10-minute progress under conditions of heat supply amount 2.33 (W/100 cm$^2$) and perspiration amount 0.5 (g/100 cm$^2$), conditions are shifted to conditions of heat supply amount 0.58 (W/100 cm$^2$) and perspiration amount 0 (g/100 cm$^2$).

In the present invention, water absorption velocity measurement by Larose method is preferred to give a value not less than 1 ml of an amount of water absorption 10 seconds after a start of the measurement, and this water absorption performance seconds after the start of measurement of not less than 1 ml enables to promptly absorb sweat of skin surface and prevent sticky touch.

The woven or knitted fabric exhibiting reversibly changeable air permeability of present invention preferably has an air permeability in 60% of moisture percentage condition is larger than an air permeability in a dried condition by 20 $cm^3/cm^2/sec$ or more. When the air permeability in 60% of moisture percentage condition is less than 20 $cm^3/cm^2/sec$ relative to the air permeability in the dried condition, the woven or knitted fabric cannot fully discharge either moisture or heat to outside environment at the time of perspiration, but can only exhibit a slower rate of drying, thereby leading to stuffiness, sticky touch, and temperature rise in clothes in a larger degree.

When using the woven and knitted fabric exhibiting reversibly changeable air permeability of the present invention for textiles, it is most preferred to use the fabric in an area facing a human skin. The knit fabric absorbs moisture and sweat generated from a skin side as described above. The fabric may provide comfortable textiles by means of air permeability variation, for example, and may be suitably used for sports and inner application.

In these textiles, it is most preferred to use the woven and knitted fabric exhibiting reversibly changeable air permeability of the present invention for 100% of garments, and the fabric may also partially be used for parts accompanied by a large amount of perspiration, such as for parts under arms of human body etc. In order to realize comfortableness, the woven or knitted fabric is preferably used in an amount not less than 20% by weight, and more preferably not less than 30% by weight.

Hereinafter, an example of manufacturing methods of the woven and knitted fabric exhibiting reversibly changeable air permeability of the present invention will be described in detail. The woven or knitted fabric exhibiting reversibly changeable air permeability of present invention needs to include a reversibly crimping cellulose acetate fiber, the fabric having reversibly crimping property that exhibits a percentage crimp of less than 10% at a humidity of not less than 95%, and a percentage crimp of not less than 20% at a humidity of not more than 45%.

The fiber includes a fiber obtained by alkali treatment of a precursor fiber through compound spinning, into a shape side by side, of cellulose acetates having difference of average degree of substitution. Preferably used is a cellulose acetate fiber having a crimp shape varying based on moisture absorption and water absorption, obtained by alkali treatment of a precursor fiber through compound spinning of a cellulose acetate having an average degree of substitution less than 2.60 and a cellulose acetate having an average degree of substitution not less than 2.76 at a weight ratio 40:60 to 75:25. In addition, the alkali treatment may be performed in a state of yarns, or may be performed in a state of woven or knitted fabrics.

More preferably, one component having a lower degree of substitution of the compounding component is completely deacetylated, from a viewpoint of expression of sufficient difference in a form variation by moisture absorption and water absorption.

Such fibers that have a reversibly changeable form by moisture absorption and water absorption preferably have not less than 10% of existence in woven or knitted fabrics, and more preferably not less than 20%, especially in order to realize comfortableness at a time of wearing.

Furthermore, the fiber may be compounded with other fibers, in a form of twisted yarn, air intermingled yarn etc. As other fibers, a polyester filament or a polyamide filament is desirable.

In the present invention, as described above, it is necessary to manufacture a woven or knitted fabric having a multilayer structure including a fiber that can provide reversible form variation by moisture absorption and water absorption and have excellent water absorption and quick-drying capability in at least one layer with a weight of 100 to 350 $g/m^2$.

The knitted fabrics having multilayer structure include knitted fabrics having two-layer structure with a front layer and a back layer and knitted fabrics having three-layered structure with a middle layer. At least one layer should include this fiber, and a skin side layer, i.e., a back layer, as a perspiration area preferably includes this fiber, from a viewpoint of effectively absorbing moisture and sweat.

The construction of the woven or knitted fabric is not in particular limited. In knitting constructions of an double-sided knitted fabric, a knitting construction with a tuck combination including a total needle construction is preferable in order to obtain changeable air permeability difference, and preferred is a double-sided knitted fabric constituted of the knitting construction having a tuck combination wherein at least one knitting construction of a front knitted fabric layer or a back knitted fabric layer includes a total needle construction.

Moreover, in knitting of a front knitted fabric layer or aback knitted fabric layer, a 1/1 construction and a total needle construction are fundamentally used for knitting 1 course, and the total needle construction is more desirable than the 1/1 construction. There may be mentioned 2/2 and 3/1 constructions etc. as knitting constructions including the total needle construction, and knitting constructions obtained by continuous knitting of two or more loops, that is, knitting constructions containing the total needle construction is preferred.

The reason why the knitting construction containing the total needle is more desirable than 1/1 construction is in a difference of yarn length. Compared with 1/1 construction, the total needle construction has a longer loop length, therefore it excels in elasticity, thereby easily providing larger air permeability difference.

Hereinafter, description of the present invention will be given, referring to examples. In addition, measurement of each characteristic value was performed according to following methods. Samples after 20 times wash (JISL 0217-1995103 method) were used for measurement of a woven or knitted fabric.

(Percentage Crimp)

Using an example fiber, a swift of 20 rounds was manufactured with a wrap reel with a 1.125 m of frame circumference, and the swift obtained was subjected to alkali treatment (1% by weight of sodium hydroxide aqueous solution, temperature of 60 to 65° C., processing period 10 minutes, liquor ratio 1:100). After dried, an initial load was applied for 1 minute, and then a total length (L0) was measured. Subsequently, after being left for 5 minutes in a predetermined humidity (measurement temperature=20° C.) with a load applied, a total length (L1) was measured.

$$\text{Percentage crimp (\%)}=(L1-L0)/L1\times 100$$

$$\text{Initial load: fineness (dtex)}\times(9/10)\times(1/10)\times 40\text{ g}$$

$$\text{Load: Fineness (dtex)}\times(0.36/1000)\times 40\text{ g}$$

(Form Stability)

A difference of forms of the woven or knitted fabric between conditions of 95% of humidity and 45% of humidity were evaluated by visual inspection. A sign ○ was given to a cloth not showing a variation of its form and a sign X was given to a cloth showing a variation of its form wherein a length of a woven or knitted fabric is increased by moisture absorption and a size of the cloth became larger.

(Residual Water Content Percentage)

A water drop of a volume of 0.1 ml was dropped onto an acrylic board on a balance, on which a woven or knitted fabric sample (10 cm×10 cm, dry weight W0 (g)) was placed, and a weight W was measured every 5 minutes. A weight after water absorption was set as W100 (g). The residual water content percentage was calculated according to following equation.

$$\text{Residual water content percentage}=(W-W0)/(W100-W0)\times 100$$

(Amount of Water Absorbed)

According to the surface absorbing-water method (Larose method) of JISL 1907, the Larose method water absorption property measuring device type TL-01 made by Toyobo Engineering was used. A sample was placed on a water containing level glass filter, then while applying a load of 480 g on this sample, an amount of water absorbed by the sample through the glass filter was measured 10 seconds after the measurement was started. At this time, a surface on a side having a higher water absorption property in a sample was used as a surface of the sample contacting the glass filter.

(Artificial Skin Temperature)

Using Kato Tech thermal physical-properties measuring device KES-7F, a predetermined amount of a water drop (equivalent to an amount of perspiration) was given on a heat board, and then a predetermined quantity of heat was applied. When the heat board temperature reached 30° C. (initial temperature), a woven or knitted fabric sample was placed on the heat board, and then the variation of heat board temperature was measured by a thermocouple of a heat board surface.

Temperature 10 minutes after measurement start was set as an artificial skin temperature 1 under condition of supply quantity of heat 2.33 (W/100 $cm^2$) and a water drop of 0.5 (g/100 $cm^2$). After measurement of the artificial skin temperature 1, temperature 5 minutes after was set as an artificial skin temperature 2 under the condition of supply quantity of heat 0.58 (W/100 $cm^2$).

Heat board area: 100 $cm^2$ (10 cm×10 cm)

Measurement conditions: 20° C., 65% RH, 0.1 m/sec wind velocity (Stuffiness, Stickiness)

An athlete's shirt was prepared using the same woven or knitted fabric as a sample, and was subjected to wearing examination. The athlete's shirt was evaluated for feeling of stuffiness and feeling of stickiness after running for 1 hour. A sing ○ is given to the athlete's shirt showing no stuffiness and stickiness and a sign X is given to the athlete's shirt showing stuffiness and stickiness.

(Air Permeability Difference)

After a woven or knitted fabric (40 cm×40 cm) was immersed in water for 24 hours, and then dried (drying period 3 minutes), the sample air-dried in an atmosphere of 20° C. and 65% for 24 hours was measured for a weight W0 (g) and air permeability as a dried sample.

After this sample was immersed in water for 24 hours, the sample was dried so that the water content might give 100%. Then, the sample was measured for a weight W (g) and air permeability every 30 minutes in an atmosphere of 20° C. and 65%. The difference obtained by subtracting the air permeability at a time of dry state from the air permeability in 60% of water content gave the air permeability difference. Air permeability was measured using a Frazil type testing machine according to JIS L 1018.

$$\text{Water content (\%)}=(W-W0)/W0\times 100$$

Air-permeability testing machine: FX33009 made by TEXTEST AG

Example 1

Each of a cellulose triacetate having an average degree of substitution of 2.91 and a cellulose diacetate having average degree of substitution of 2.41 was dissolved in a mixed solvent of methylene chloride 91% by weight/methanol 9% by weight to prepare a spinning stock solution having 22% by weight of a cellulose triacetate concentration and a spinning stock solution having 22% by weight of a cellulose diacetate concentration. These spinning stock solutions were spun in a dry-compound-spinning method to obtain a filament having 84 dtex/20 filament with a side-by-side cross section, the filament having a weight ratio of a cellulose-diacetate component and a cellulose triacetate component of 50:50. The obtained compound acetate filament gave a percentage crimp of 7% under condition of 95% of humidity, and a percentage crimp of 25% under condition of 45% of humidity.

The acetate fiber and a polyester filament yarn of 33 dtex/12 filament were air-intermingled to give an intermingled yarn. Following reversible knitted fabric was prepared with this yarn.

Reversible Knitted Fabric

Knitting machine: 30-inch, 28 gauges

Knitted construction: front layer and back layer in all-needle stitch constructions, binding by 1/1 double-sided tuck Yarn configuration: polyester fiber 110 dtex 24 filament for a front layer; polyester fiber 56 dtex 24 filament for a tuck section; the above-mentioned intermingled yarn for a back layer The obtained reversible knitted fabric was alkali-treated under following conditions, and then dyed at 130° C. The dyed fabric was heat-set in a 170° C. tenter to obtain a reversible knitted fabric. A basis weight of the obtained knitted fabric gave 235 g/$m^2$.

Alkali Treatment Conditions

Alkali-treatment liquid: 1% by weight of sodium hydroxide aqueous solution

Treating solution liquor ratio: 1:100

Treatment temperature: 60° C.

Processing period: 15 minutes

Table 1 shows evaluation results of the obtained knitted fabric. A crimp shape of the compound acetate filament used in the back layer varied with humidity gave a resultant variation in air permeability of the knitted fabric. In wear examination, this knitted fabric did not exhibit stuffiness and sticky touch.

Example 2

A following broad stitch reversible knitted fabric was prepared using a same intermingled yarn of a compound acetate fiber and a polyester fiber as the intermingled yarn in Example 1. A same alkali treatment and dyeing finish in Example 1 were given to the knitted fabric to obtain a reversible knitted fabric. The mass per unit area of the obtained knitted fabric gave 215 g/m$^2$.

Broad Stitch Reversible Knitted Fabric

Knitting machine: 30-inch, 28 gauges

Knitted construction: front layer in all-needle stitch; back layer is 1/1 broad stitch construction, binding by double-sided tuck Yarn configuration: a polyester fiber 110 dtex 24 filament for a front layer; a polyester fiber 56 dtex 24 filament for a tuck section; the above-mentioned intermingled yarn for a back layer Table 1 shows evaluation results of the obtained knitted fabric. A crimp shape of the compound acetate filament used in the back layer varied with humidity gave a resultant variation in air permeability of the knitted fabric. In wear examination, this knitted fabric did not show stuffiness and sticky touch.

Comparative Example 1

A reversible knitted fabric was prepared in a same manner as in Example 1, except for having used a polyester fiber of 110 dtex/48 filament for a back layer. The mass per unit area of the obtained knitted fabric gave 230 g/m$^2$. Table 1 shows evaluation results of the obtained knitted fabric. Since this knitted fabric did not give a variation of air permeability based on humidity, the knitted fabric gave stuffiness and sticky touch.

Comparative Example 2

A knitted fabric was prepared in a same manner as in Example 1, except for having knit a plain knitted fabric having one-layer structure by 28 G using an intermingled yarn used in Example 1. The mass per unit area of the obtained knitted fabric gave 80 g/m$^2$. Table 1 shows evaluation results of the obtained knitted fabric. Although this knitted fabric gave air permeability varied with humidity variation, it elongated with high humidity, thereby providing poor dimensional stability.

Example 3

Each of a cellulose triacetate having an average degree of substitution of 2.91 and a cellulose diacetate having average degree of substitution of 2.41 was dissolved in a mixed solvent of methylene chloride 91% by weight/methanol 9% by weight to prepare a spinning stock solution having 22% by weight of a cellulose triacetate concentration and a spinning stock solution having 22% by weight of a cellulose diacetate concentration. These spinning stock solutions were spun in a dry-compound-spinning method to obtain a filament having 110 dtex/26 filament with a side-by-side cross section, the filament having a weight ratio of a cellulose-diacetate component and a cellulose triacetate component of 50:50. The obtained compound acetate filament gave a percentage crimp of 9% under condition of 95% of humidity, and a percentage crimp of 27% under condition of 45% of humidity.

A following mesh reversible knitted fabric (mass per unit area 185 g/m$^2$) was prepared, using an intermingled yarn obtained by intermingle of the cellulose acetate fiber and a polyester fiber of 33 dtex/8 filament for a back layer, and a polyester fiber of 110 dtex/48 filament for a front layer.

Mesh Reversible Knitted Fabric

Knitting machine: 30-inch, 28 gauges

Knitted construction: front layer in all-needle stitch construction; back layer in single tuck mesh construction of all-needle stitch construction, Yarn configuration: a polyester fiber 110 dtex 24 filament for a front layer; the above-mentioned intermingled yarn for a back layer Subsequently, performed was an alkali treatment giving 17.5% of weight reduction rate to the obtained knitted fabric under following conditions. The weight reduction rate was calculated by a weight change before and after the alkali treatment.

Alkali Treatment Conditions

Alkali-treatment liquid: 1% by weight of sodium hydroxide aqueous solution

Treating solution liquor ratio: 1:100

Treatment temperature: 60° C.

Processing period: 10 minutes

Table 2 shows evaluation results of the obtained knitted fabric. A crimp shape of the cellulose acetate filament used in the back layer varied with humidity gave a resultant variation in air permeability of the knitted fabric. In wear examination, this knitted fabric did not show stuffiness and sticky touch.

Comparative Example 3

A mesh reversible knitted fabric (mass per unit area 185 g/m$^2$) with the same knitted construction as in Example 3 was prepared using a polyester fiber of 110 dtex/48 filament for a front layer and a back layer. Table 2 shows evaluation results of the obtained knitted fabric. Since this knitted fabric did not give a variation of air permeability based on humidity, the knitted fabric gave stuffiness and sticky touch to large extent.

Comparative Example 4

A mesh reversible knitted fabric (mass per unit area 230 g/m$^2$) with the same knitted construction as in Example 3 was prepared using a cotton yarn with a yarn count of 40/1 for a front layer and a back layer. Table 2 shows evaluation results of the obtained knitted fabric. Since this knitted fabric gave a little variation of air permeability based on humidity and great water holding property, the knitted fabric gave stuffiness and sticky touch to large extent.

TABLE 1

| | Example 1 | Example 2 | Comparative example 1 | Comparative example 2 |
|---|---|---|---|---|
| Residual water content percentage % (20 minutes) | 29.5 | 30.1 | 61.6 | 38.5 |
| Air permeability difference (cm$^3$/cm$^2$/sec) | 64.5 | 70.0 | 3.0 | 160 |
| Stuffiness, sticky touch | ○ | ○ | X | ○ |
| Shape stability | ○ | ○ | ○ | X |

TABLE 2

| | Example 3 | Comparative example 3 | Comparative example 4 |
|---|---|---|---|
| Residual water content percentage % (20 minutes) | 30.5 | 61.7 | 92.0 |
| Water absorption amount (ml) | 1.69 | 0.03 | 1.73 |
| Air permeability difference ($cm^3/cm^2/sec$) | 58.2 | 0 | 23 |
| Initial temperature (° C.) | 30 | 30 | 30 |
| Artificial skin temperature 1 (° C.) | 33.0 | 36.0 | 35.0 |
| Artificial skin temperature 2 (° C.) | 28.6 | 32.1 | 30.4 |
| Stuffiness, sticky touch | ○ | X | X |

The invention claimed is:

1. A woven or knitted fabric exhibiting reversibly changeable air permeability of a multilayer structure, wherein a front layer consists of a polyester fiber and a back layer consists of a mixed yarn of a polyester fiber and a cellulose acetate fiber having reversibly crimping property, and wherein the cellulose acetate fiber exhibits a percentage crimp of less than 10% at a humidity of not less than 95% and a percentage crimp of not less than 20% at a humidity of not more than 45%, and the woven or knitted fabric has a basis weight of 100 to 350 $g/m^2$.

2. The woven and knitted fabric exhibiting reversibly changeable air permeability according to claim 1, exhibiting not more than 50% of residual water content percentage 20 minutes after a start of measurement in the measurement of the residual water content percentage.

3. The woven or knitted fabric exhibiting reversibly changeable air permeability according to claim 1, wherein a temperature rise after 10 minutes in measurement of an artificial skin temperature is not more than 4° C. under conditions of a heat supply amount 2.33 (w/100 $cm^2$) and a perspiration amount 0.5 (g/100 $cm^2$), and the artificial skin temperature drops to a temperature not more than an initial temperature within 5 minutes under conditions of a heat supply amount 0.58 (w/100 $cm^2$) and a perspiration amount 0 (g/100 $cm^2$).

4. The woven or knitted fabric exhibiting reversibly changeable air permeability according to claim 1, wherein water absorption velocity measurement by a Larose method gives a value not less than 1 ml of an amount of water absorption 10 seconds after a start of the measurement.

5. The woven or knitted fabric exhibiting reversibly changeable air permeability according to claim 1, wherein the front layer and the back layer have a different density.

6. The woven or knitted fabric exhibiting reversibly changeable air permeability according to claim 5, wherein a ratio of the density of the front layer and the back layer is not less than 1.2.

7. The woven or knitted fabric exhibiting reversibly changeable air permeability according to claim 1, wherein the multilayer structure comprises a middle layer in addition to the front layer and the back layer.

* * * * *